United States Patent [19]

Naito et al.

[11] 4,406,613

[45] Sep. 27, 1983

[54] SAFETY APPARATUS FOR ROOM HEATING DEVICE

[75] Inventors: Susumu Naito; Toshifumi Yamana, both of Nagoya, Japan

[73] Assignee: Rinnai Kabushiki Kaisha, Aichi, Japan

[21] Appl. No.: 292,936

[22] Filed: Aug. 14, 1981

[51] Int. Cl.[3] ..... F23N 5/00

[52] U.S. Cl. ..... 431/76; 126/110 B

[58] Field of Search ..... 431/75, 76, 20; 236/15 E; 307/117, 118; 126/110 B

[56] References Cited

U.S. PATENT DOCUMENTS 2,835,886 5/1958 Bogdanowski et al. ..... 431/76

4,125,356 11/1978 Ohashi et al. ..... 431/76

4,231,733 11/1980 Hickam et al. ..... 431/76

*Primary Examiner*—Lee E. Barrett

*Attorney, Agent, or Firm*—Armstrong, Nikaido, Marmelstein & Kubovcik

[57] ABSTRACT

A safety apparatus for shutting down a room heating device upon detecting incomplete combustion in the burner of the heating device. A detecting element is arranged to provide an output to a setting circuit. When the output changes due to a change in combustion, the circuit cuts off fuel supply. Additional circuitry is provided to vary the predetermined operation level of the circuit depending on whether a room air circulation fan is operating or not.

4 Claims, 4 Drawing Figures

SAFETY APPARATUS FOR ROOM HEATING DEVICE

BACKGROUND OF THE INVENTION

This invention relates to a safety apparatus for a room heating device for preventing an accident because of lack of oxygen at a burner at the time of room heating.

Incomplete combustion of gas in a burner caused by a low oxygen concentration in the combustion air can result in contamination of the air with carbon monoxide in a room during a room heating operation. In this view, there has been hitherto proposed a certain safety apparatus utilizing the incomplete combustion of a burner as a barometer of the degree of contamination of the air in the room. The incomplete combustion is detected by a combustion detecting element. When a detecting output thereof is changed to a predetermined operation level, the gas supply to the burner is cut off to prevent an oxygen deficiency accident. However, the state of contamination of air in the room during room heating is such that the degree of contamination of air is higher at an upper position in the room by the drafting of combustion exhaust gas. Accordingly, in the case of using a floor-type heating device installed on a floor, when the oxygen concentration in air supplied from the lower portion of the interior of the room is so lowered as to cause incomplete combustion of the burner, there is a danger of contamination of the air at the upper portion of the room going beyond an allowable value. In this case, if there is provided a room air-circulation fan inside or outside the heating device so that air in the room may be circulated forcibly, there is no difference in upper and lower air contamination degrees and the above danger is removed. However, in some cases, some of the users do not like a warm wind blowing against them, and therefore it is desirable to secure safety regardless of operation and non-operation of the circulation fan.

SUMMARY OF THE INVENTION

The present invention has as an object the provision of a safety device for a room heating device which detects incomplete combustion of the burner and cuts off the burner to prevent potential accidents.

A further object of the present invention is to provide a safety device having different levels of sensing incomplete combustion depending on whether an air circulation fan in the heater is turned on or not.

A still further object of the present invention is to provide a safety device having a selection option for detecting incomplete combustion depending on the type of gas to be burned.

The present invention comprises a safety apparatus for a room heating device which has a burner, a room air circulation fan and a detecting element for detecting incomplete combustion of a burner. The apparatus is so arranged that, when detecting output of the element is changed to a predetermined operation level set by a setting means, a gas supply to the burner is cut off and it is characterized in that the setting means comprises means for changing the predetermined operation level in accordance with operation or non-operation of the room air circulation fan which is provided inside or outside the room heating device.

The setting means can comprise a divider circuit which inputs a standard voltage to a comparator, to which a detecting voltage from a detecting element is inputted. The means for changing includes a resistance connected to the potential divider circuit for varying a voltage ratio, and a changeover switch is arranged to be closed and opened by the operation and non-operation, respectively, of switch means for operating the fan which connects the resistance into the circuit.

The apparatus can further include a means for negating the means for changing if the type of fuel being used is changed.

The means for negating can simply comprise an operation switch inserted in series with the change-over switch.

These and other objects and the attendant advantages of the present invention will become apparent to a person of skill in the art from the following description, taken in conjunction with the accompanying drawings.

DETAILED DESCRIPTION OF THE PREFERRED EMBODIMENTS

Figure 1:
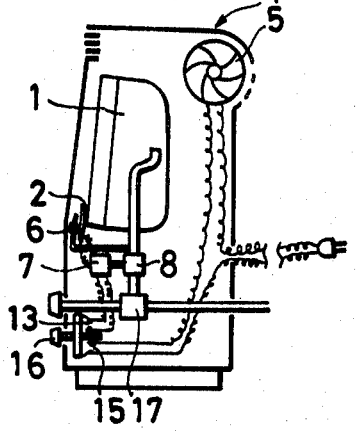
FIG. 1 is a sectional side view of a room heating device provided with this invention apparatus.

A room heating device 4 is provided with a detecting element 2 for detecting incomplete combustion of a burner thereof and is so arranged that when detecting output of the element 2 is changed to a predetermined operation level set by a setting means 3, the gas supply to the burner 1 is cut off. The setting means 3 is constructed to be variable in its operation level in accordance with the operation or the non-operation of a room air circulation fan 5 provided inside or outside the room heating device 4. The detecting element 2 is so constructed that electrode layers of porous platinum electrode or the like are formed on the front and rear surfaces of a sintered body or an oxygen-ion-conductive electrode, such as zirconia or the like. Thus, the same operates in such a manner that if heated to a predetermined operation temperature, its internal resistance is decreased and an electromotive force corresponding to a difference in oxygen concentration between the two electrode layers is generated. In the illustrated example, the element 2 is disposed between the burner 1 provided in the room heating device 4 and a pilot burner 6 in front of the burner 1. The outer electrode layer facing the pilot burner 6 is continuously in contact with the flame of the pilot burner 6 or the combustion exhaust gas thereof, so as to be in an atmosphere of low oxygen concentration. Thus, in a normal condition, a comparatively large oxygen concentration difference exists between the outer facing electrode layer and the inner facing electrode layer facing the burner 1, for generating an electromotive force corresponding to the oxygen concentration difference.

Figure 4:
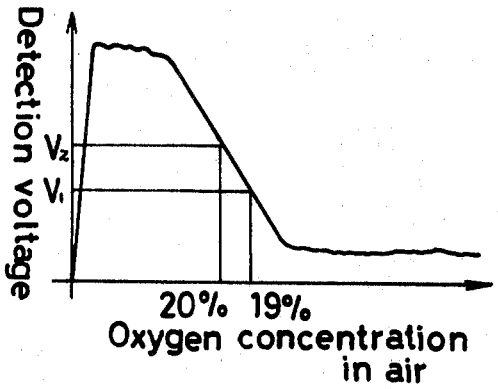
FIG. 4 is a diagram showing an output characteristic of a detecting element.

With this arrangement, when incomplete combustion of the burner 1 occurs by a lowering in oxygen concentration in the air supplied for combustion, the combustion flame or the combustion exhaust gas of the burner 1 contacts the inner electrode layer by the lifting upwards of the combustion flame or the like and causes a lowering in oxygen concentration in the atmosphere of the electrode layer. A decrease in the oxygen concentration difference between the two electrode layers, that is, a decrease in the electromotive force, thereby results. The changing characteristics of the electromotive force in relation to oxygen concentration in air is shown in FIG. 4.

Figure 2:
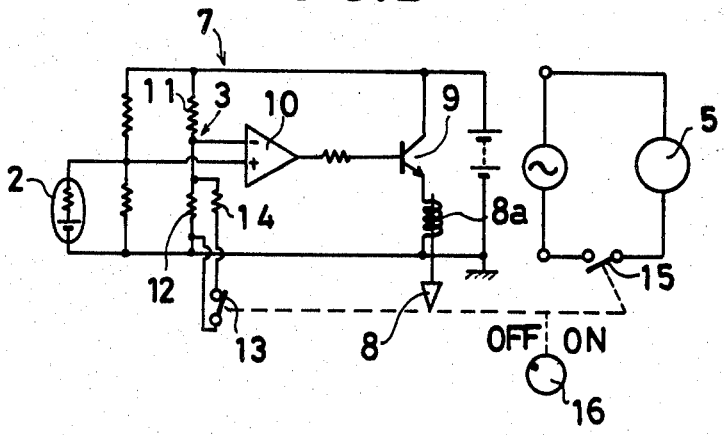
FIG. 2 is a circuit diagram of one example of this invention apparatus.

In the illustrated example in FIG. 1, the room air circulation fan 5 is provided in a housing of the heating device 4 but it is, of course, possible to provide the same outside the housing. In the drawing, a control circuit 7 is connected to the element 2 and is arranged to control a safety valve 8 interposed in the gas supply passage. The control circuit 7 is provided, as shown in FIG. 2, with a transistor 9 connected in series to an operation solenoid 8*a* of the safety valve 8 and a comparator 10 of which an output terminal is connected to a base terminal of the transistor 9. An electromotive force from the detecting element 2 is inputted to the input terminal on one side of the comparator 10 and, at the same time, a standard electric voltage from the setting means 3 comprising a voltage divider circuit is inputted to an input terminal on the other side of the comparator 10. When the electromotive force is lowered to an operation level predetermined by the standard voltage, the transistor 9 becomes non-conductive so that the electric current supplying to the operation solenoid 8*a* is cut off. Consequently, the safety valve 8 is closed to cut off the gas supply to the burner 1.

The setting means 3 is constructed having a third resistance 14 in parallel connected through a changeover switch 13 to a second potential divider resistance 12 on the ground side of the pair of first potential divider resistance 11 and second potential divider resistance 12. The changeover switch 13 is arranged so as to be moved with an operation member 16 for operating the operation switch 15 for the room air circulation fan 5. The switch 13 is closed at an OFF position of the operation member 16 and is opened at an ON position thereof. In FIG. 1, a gas cock 17 is interposed in the gas supply passage on the upstream side of the foregoing solenoid safety valve 8.

The operation of the foregoing embodiment is explained as follows:

When the room air circulation fan 5 is operated by moving the operation member 16 to the ON position, the changeover switch 13 is open so that the predetermined operation level of the setting means 3 is set by the first and second potential divider resistances 11,12 and a standard voltage of $V_1$ as shown in FIG. 4. If, in this condition, oxygen concentration in air is decreased to 19%, the detecting voltage from the detecting element 2 is decreased to the operation level of $V_1$, and thereby the safety valve 8 is closed.

At the time of non-operation of the fan 5 with the operation member 16 being turned to the OFF position, the changeover switch 13 is closed and the third resistance 14 is connected to the second potential divider resistance 12 in parallel one-to-another, so that the standard voltage from the setting means 3 is raised to $V_2$. The detecting voltage is decreased to the standard level of $V_2$ before the oxygen concentration in air is decreased to 19%, for instance, when the same is decreased to 20% and thereby the safety valve 8 is closed.

When this operation is carried out, even if there has been already produced about 1% of a difference between the oxygen concentration in the air at the upper portion of the room and that in the air at the lower portion thereof by a difference between the contamination degree of air at the upper and lower portions of the interior of the room during non-operation of the fan 5, the safety valve 8 is closed when the oxygen concentration in the air at the lower portion to be used as air for combustion of the burner 1 is decreased to 20%, so that the oxygen concentration in air at the upper portion is never decreased to less than 19%.

If the kind of gas to be used is changed from a general town gas having a Wobbe index of as small as 6C or so to a natural gas such as LPG or methane gas having a Wobbe index larger than the above, incomplete combustion can occur if the fan 5 is not operating in an oxygen concentration which is higher than the oxygen concentration when the fan is operating, so that the detecting voltage becomes lower. Accordingly, even if the operation level is not raised from $V_1$ to $V_2$, the safety valve 8 can be closed in a higher oxygen concentration condition than the oxygen concentration in which the incomplete combustion occurs at the time when the fan 5 is operating.

The reason for the above is that an amount of air supply to the burner 1 is varied more or less with the operation and non-operation of the fan 5 and, in the case of a gas which is large in Wobbe index, namely, large in oxygen consumption amount, the gas responds sensitively to decrease in air supply amount at the time of non-operation of the fan 5 so that the incomplete combustion is caused even by a small lowering in oxygen concentration in the air.

Figure 3:
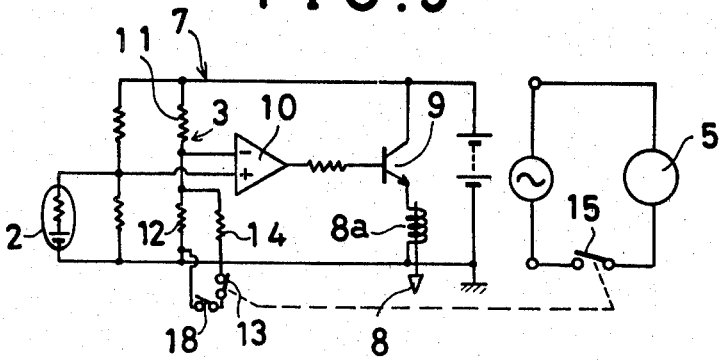
FIG. 3 is a circuit diagram of another example of this invention apparatus.

Accordingly, in another example shown in FIG. 3, for preparation for changing of the kind of gas to be used, a switch 18 is to be closed for the gas which is 6C in Wobbe index but be opened for LPG, is connected in series to the changeover switch 13. The circuit is arranged so that, at the time of use of LPG, the safety valve 8 is closed by lowering of the detecting voltage to a predetermined operation level irrespective of the operation of non-operation of the fan 5.

The above has been explained using an oxygen concentration cell element as the detecting element 2, but this invention can also utilize a resistance variable element, such as titania or the like, as the detecting element.

Thus, according to this invention, an operation level for a detecting output of a detecting element 2 for cutting off a gas supply is so arranged as to be changeable in accordance with operation and non-operation of a room air circulation fan 5 so that, even if a difference in contamination degree of air between upper and lower portions of a room occurs, the gas supply can be cut off by a comparatively low contamination degree of air at the lower portion of the room so that any contamination of air at the upper portion beyond an allowable value can be prevented. Thus, safety can be ensured irrespective of operation and non-operation of the fan 5.

What is claimed:

1. A safety apparatus for a room heating device having a burner, means for supplying gas to said burner, cut-off means for cutting off said means for supplying upon receiving a cut-off signal, a room air circulation fan, detecting means for detecting incomplete combustion of said burner and for producing an output upon detection of incomplete combustion, setting means for setting a predetermined operation level, comparator means coupled to said cut-off means, said detecting means, and said setting means for comparing the output of said detecting means and said setting means and for generating said cut-off signal when the output of said detecting means is at said predetermined operation level thereby cutting off the gas to the burner, characterized in that said setting means comprises means for changing the predetermined operation level in accordance with operation or non-operation of the room air circulation fan.

2. A safety apparatus as claimed in claim 1 wherein the setting means comprises a voltage divider circuit inputting a standard voltage to said comparator means and wherein said detecting means produces a detecting voltage which is applied to said comparator means, and wherein said means for changing includes a resistance connected to the voltage divider circuit for varying a voltage ratio thereof and a changeover switch arranged to be closed and opened by the operation and non-operation of the switch means for operating the fan connecting the resistance into the circuit.

3. A safety apparatus as claimed in claim 1 wherein the setting means further includes means for negating the means for changing.

4. A safety apparatus as claimed in claim 3 wherein the setting means comprises a voltage divider circuit inputting a standard voltage to said comparator means, and wherein said detecting means produces a detecting voltage which is applied to said comparator means, and wherein said means for changing includes a resistance connected to the voltage divider circuit for varying a voltage ratio thereof and a changeover switch arranged to be closed and opened by the operation and non-operation of switch means for operating the fan, connecting the resistance into the circuit and said means for negating includes an operation switch connected in series with the changeover switch.

* * * * *